US007618108B2

(12) United States Patent
Ito

(10) Patent No.: US 7,618,108 B2
(45) Date of Patent: Nov. 17, 2009

(54) INKJET RECORDING APPARATUS

(75) Inventor: Masaharu Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 95 days.

(21) Appl. No.: 11/420,618

(22) Filed: May 26, 2006

(65) Prior Publication Data

US 2006/0268032 A1 Nov. 30, 2006

(30) Foreign Application Priority Data

May 27, 2005 (JP) ..... 2005-156067

(51) Int. Cl.
*B41J 29/38* (2006.01)

(52) U.S. Cl. ..... 347/10; 347/11; 347/17

(58) Field of Classification Search ..... 347/5, 347/9–12, 14, 15, 19, 17
See application file for complete search history.

(56) References Cited

U.S. PATENT DOCUMENTS 6,561,610 B2 5/2003 Yamasaki et al.
6,764,153 B2 7/2004 Tanaka

FOREIGN PATENT DOCUMENTS

JP 2000103042 4/2000
JP 2000158643 * 6/2000
JP 2002292848 10/2002
JP 2003237059 8/2003
JP 2003285453 10/2003

* cited by examiner

*Primary Examiner*—Lam S Nguyen
(74) *Attorney, Agent, or Firm*—Baker Botts L.L.P.

(57) ABSTRACT

An inkjet recording apparatus including: a recording head movable in a main scanning direction, and including: an ink passage; a nozzle communicated with the passage; and an actuator applying energy to ink in the passage to eject a droplet thereof from the nozzle; a control device outputting a drive waveform signal, while the head is moved in the direction, to drive the actuator, the control device including: a storing portion storing plural kinds of the signals different from one another in the number of the ejected droplets for one dot; and an outputting portion including: a determining portion making at least one of the following determinations, for each particular one of dots printed in series at least in the direction: whether there is a dot printed immediately before the particular dot, and whether there is a dot printed immediately after the particular dot; and a selecting portion selecting one of the kinds of the signals, based on a result of the determination made by the determining portion, and outputting the selected kind of the signal to the actuator; and the selecting portion selecting (i) a first one of the kinds of the signals, when a result of the determination is affirmative, and (ii) a second one of the kinds of the signals, when the result of the determination is negative, the first kind and second king respectively being for ejecting a first number and a second number of the droplet or droplets for the particular dot, the second number being smaller than the first number.

7 Claims, 10 Drawing Sheets

FIG.8

| | | DRIVE SIGNAL | | | | | |
|---|---|---|---|---|---|---|---|
| | | P28-PGX | P28-PGY | P28FR-PGX | P28FR-PGY | P28NR-PGX | P28NR-PGY |
| TEMPERATURE | 10 | 0.143 | 0.1248 | 0.115 | 0.1150 | 0.095 | 0.1146 |
| | 15 | 0.143 | 0.1230 | 0.109 | 0.1133 | 0.093 | 0.1133 |
| | 20 | 0.143 | 0.1160 | 0.110 | 0.1121 | 0.089 | 0.1124 |
| | 25 | 0.145 | 0.1126 | 0.113 | 0.1126 | 0.095 | 0.1131 |
| | 30 | 0.139 | 0.1050 | 0.099 | 0.1050 | 0.079 | 0.1020 |
| | 35 | 0.136 | 0.1018 | 0.093 | 0.1013 | 0.083 | 0.1013 |
| | 38 | 0.136 | 0.1005 | 0.099 | 0.0990 | 0.076 | 0.1003 |

INKJET RECORDING APPARATUS

INCORPORATION BY REFERENCE

The present application is based on Japanese Patent Application No. 2005-156067, filed on May 27, 2005, the contents of which is incorporated herein by reference.

BACKGROUND OF THE INVENTION

1. Field of the Invention

The invention relates to an inkjet recording apparatus which includes a nozzle and an actuator, and ejects an ink droplet from the nozzle onto a recording medium by driving the actuator, thereby recording an image or information on the recording medium.

2. Description of Related Art

As a kind of an inkjet recording apparatus of this type, the publications 1-4 set forth below disclose apparatuses that control printing of dots in order to prevent blurring or spreading of ink that is a phenomenon that when a droplet of ink is ejected onto a recording medium to form a dot on an outline of an image recorded on the recording medium, the ejected ink droplet grows or spreads on the recording medium into a white, non-recording area in the recording medium, thereby increasing the size of the dot. This phenomenon will be hereinafter referred to as "dot growth". The prevention of the dot growth is essential particularly in recording apparatuses for recording codes such as one-dimensional or two-dimensional barcodes, such as those apparatuses disclosed in the publications 1 and 3, since a misreading of a barcode should not occur.

Publication 1: JP-A-2003-237059
Publication 2: JP-A-2002-292848
Publication 3: JP-A-2000-103042
Publication 4: JP-A-2003-285453

Each of the recording apparatuses disclosed in the publications 1-3 is constructed to print a single dot by ejecting a single ink droplet from a nozzle onto a recording medium, and to print an outline of an image by ejecting small ink droplets each of which is smaller in volume than ink droplets ejected for forming the other part of the image than the contour or outline. According to this arrangement, a size of a single dot formed on the recording medium depends on a volume of a single ink droplet. Hence, a variation in volume of ink droplets significantly affects the uniformity in shape, size and density of the dots formed by the ink droplets on the recording medium, thereby deteriorating the quality of the image at the outline thereof Meanwhile, the recording apparatus disclosed in the publication 4 is constructed to print an outline of an image by forming dots each of which is formed by a single ink droplet, and print the other part of the image by forming dots each of which is formed by two or three ink droplets. Both of the outline and the other part of the image are printed according to a drive waveform signal consisting of a series of pulses that form a waveform. More specifically, timing signals are inserted in the common drive waveform signal at suitable timings to divide the drive waveform signal to provide three kinds of signals of respective waveforms, as needed. That is, a first kind of drive waveform signal for ejecting a single droplet, a second kind of drive waveform signal for ejecting two droplets, and a third kind of drive waveform signal for ejecting three droplets, are provided by dividing the common drive waveform signal with the timing signals. However, after ejection of an ink droplet or ink droplets, a change in ink pressure remains in an ink passage, an end of which constitutes a nozzle, and the state of the remaining change in the ink pressure varies in a manner depending on the number of ink droplet or droplets having been ejected in series. Hence, the different kinds of drive waveform signals respectively for ejecting one, two and three ink droplets in series, which signals are obtained by simply segmenting the common drive waveform signal with the timing signals can not apply to the ink, energy of a level appropriate for ejecting each number of ink droplet or droplets. Accordingly, at the outline of the recorded image, the print quality is relatively low.

Thus, any of the recording apparatuses disclosed in the publications 1-4 succeeds in accurately controlling the size of printed dots, that is, dots at an outline of an image recorded by the recording apparatuses may enlarge or grow to degrade the print quality.

SUMMARY OF THE INVENTION

It is an object of this invention to provide an inkjet recording apparatus which can solve the above-described problems and enhance the print quality of an image at an outline.

To attain the above object, the invention provides an inkjet recording apparatus including:

- a recording head which is movable in a main scanning direction, and includes:
  - an ink passage with ink therein;
  - a nozzle in communication with the ink passage; and
  - an actuator for applying energy to the ink in the ink passage to eject the ink in the form of a droplet from the nozzle;
- a control device which outputs a drive waveform signal while the recording head is moved in the main scanning direction, in order to drive the actuator to eject the ink droplet, the control device including:
  - a storing portion which stores a plurality of kinds of the drive waveform signals that differ from one another in the number of the ink droplets ejected for printing one dot; and
  - an outputting portion including:
    - a determining portion which makes at least one of the following two determinations, with respect to each particular one of dots printed in series at least in the main scanning direction: (a) a first determination whether there is a dot to be printed immediately before the particular dot, and (b) a second determination whether there is a dot to be printed immediately after the particular dot; and
    - a selecting portion which selects one of the plurality of kinds of the drive waveform signals stored in the storing portion, based on the determination made by the determining portion, and outputs the selected kind of the drive waveform signal to the actuator; and the selecting portion selecting (i) a first one of the plurality of kinds of the drive waveform signals, when a result of the determination made by the determining portion is affirmative, and (ii) a second one of the plurality of kinds of the drive waveform signals, when the result of the determination is negative, the first kind of the drive waveform signal being for ejecting a first number of the ink droplets for the particular dot, and the second kind of the drive waveform signal being for ejecting a second number of the ink droplet or droplets which second number is smaller than the first number.

The inkjet recording apparatus includes a type that does not require, throughout recording of an image, to receive print data from an exterior higher-level device such as host computer, and another type that includes a lower-level device mainly performing recording, and an upper-level device to which the lower-level device is connected and which supplies print data to the lower-level device. The latter type may be a combination of a printer and a personal computer connected thereto. In the latter type of the inkjet recording apparatus, each of the "control device", "storing portion", "outputting portion", "determining portion" and "selecting portion" may be disposed in either of the upper-level device and the lower-level device.

In general, a plurality of satellite droplets are ejected along with a principal ink droplet, on application of a single printing pulse. The satellite droplets usually land on a substantially same place in a recording medium to form one dot. Hence, the principal ink droplet and the satellite droplets are collectively considered to be a single ink droplet.

According to this recording apparatus, when the result of the determination indicates that a dot is to be printed immediately before and/or after a particular dot, a kind of drive waveform signal for ejecting a first number of ink droplets is outputted to the actuator for forming the particular dot, and when the result of the determination indicates that a dot is not to be printed immediately before and/or after the particular dot, a kind of drive waveform signal for ejecting a second number of ink droplets, which second number is smaller than the first number, is outputted to the actuator. That is, at an outline of an image to be recorded, strictly, at at least a part of the outline, the number of ink droplets ejected is decreased to reduce a sum of volumes of ink droplets that together form a single dot. Hence, as compared to an inkjet recording apparatus where the volume of a single ink droplet is adjusted, namely, reduced at an outline of an image, the shape, size and density of the dots constituting the outline of the image are accurately controllable.

Further, since the actuator is driven by drive waveform signals corresponding to the respective numbers of ink droplets to be ejected for each particular dot to be printed, the shape, size and density of each printed dot can be accurately controlled.

In view of factors including that the state of the remaining change in ink pressure in the ink passage after an ink droplet is ejected from a nozzle, varies in a manner depending on the number of ink droplets ejected in series, a plurality of kinds of drive waveform signals for respective cases of ejection of respective numbers of ink droplets are stored in the storing portion, so that an appropriate one of all the kinds of drive waveform signals stored in the storing portion is selected for a particular dot and outputted to the actuator. Thus, energy of a level optimum for the number of ink droplets to be ejected in series for the particular dot can be applied to the ink, thereby enabling to accurately control the shape, size and density of the dots constituting the outline of the image.

The recording head of the inkjet recording apparatus may have individual specificity in properties such as the flow resistance of the ink passage, and accordingly there may be variation in the ink ejection characteristic among produced recording heads. However, a plurality of kinds of drive waveform signals corresponding to the specificity of each recording head can be tailored in order to eliminate adverse influence of the variation in the ink ejection characteristic from head to head. Thus, according to this invention, the growth of each dot at an outline of a recorded image is restrained, thereby enhancing the print quality of the image.

The invention also provides an inkjet recording apparatus, including:

a recording head which is movable in a main scanning direction, and includes:

an ink passage with ink therein;

a nozzle in communication with the ink passage; and an actuator for applying energy to the ink in the ink passage to eject the ink in the form of a droplet from the nozzle;

a control device which outputs a drive waveform signal, while the recording head is moved in the main scanning direction, in order to drive the actuator to eject the ink droplet, the control device including:

a temperature detecting portion which detects a temperature of an environment in which the apparatus is situated; and an outputting portion which makes at least one of the following two determinations, with respect to each particular one of dots printed in series at least in the main scanning direction: (a) a first determination whether there is a dot to be printed immediately before the particular dot, and (b) a second determination whether there is a dot to be printed immediately after the particular dot, and which outputs, to the actuator and for the particular dot, (i) a first one of a plurality of kinds of the drive waveform signals, which is for ejecting a first number of the ink droplets, when a result of the determination is affirmative, (ii) a second one of the plurality of kinds of the drive waveform signals, which is for ejecting a second number of the ink droplets, when the result of the determination is negative and the temperature detected by the temperature detecting portion is higher than a threshold, and (iii) a third one of the plurality of kinds of the drive waveform signals which is for ejecting a third number of the ink droplet or droplets, which third number is smaller than the second number, when the result of the determination is negative and the temperature detected by the detecting portion is not higher than the threshold.

The first number and the second number may or may not be the same.

According to a result of an experiment conducted by the present inventor, when dots are sequentially printed in the main scanning direction while the temperature of the environment in which the recording apparatus is situated is relatively low to make the viscosity of the ink relatively high, an ink droplet forming each printed dot tends to spread more greatly in the main scanning direction than in an auxiliary scanning direction in which the recording medium is fed.

One of the reasons for this can be the following. The viscosity of the ink increases with decrease in the temperature of the ink. Hence, when printing of one dot is performed while the ink temperature is relatively low and such that the one dot is formed by a plurality of ink droplets, the ink droplets do not land at an exactly same position in the recording medium, resulting in an enlargement or growth of the printed dot. This tendency is more grave in the main scanning direction than in the auxiliary scanning direction.

However, according to this apparatus, when a dot on the outline of the image is to be printed, the number of ink droplets ejected for printing the dot on the outline is reduced where the temperature of the environment in which the recording apparatus is situated (hereinafter simply referred to as "environmental temperature") is not higher than the threshold, in order to eliminate the growth of the dot at least in the main scanning direction. Thus, the print quality of the image at the outline is enhanced.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 8 is a table showing a result of an experiment conducted by the inventor.

DETAILED DESCRIPTION OF PREFERRED EMBODIMENTS

Hereinafter, there will be described presently preferred embodiments of the invention, by referring to the accompanying drawings.

First Embodiment

There will be described an inkjet recording apparatus according to a first embodiment of the invention, by referring to FIGS. 1-5 and FIGS. 7A-7C.

[General Structure of the Inkjet Recording Apparatus]

Figure 1:
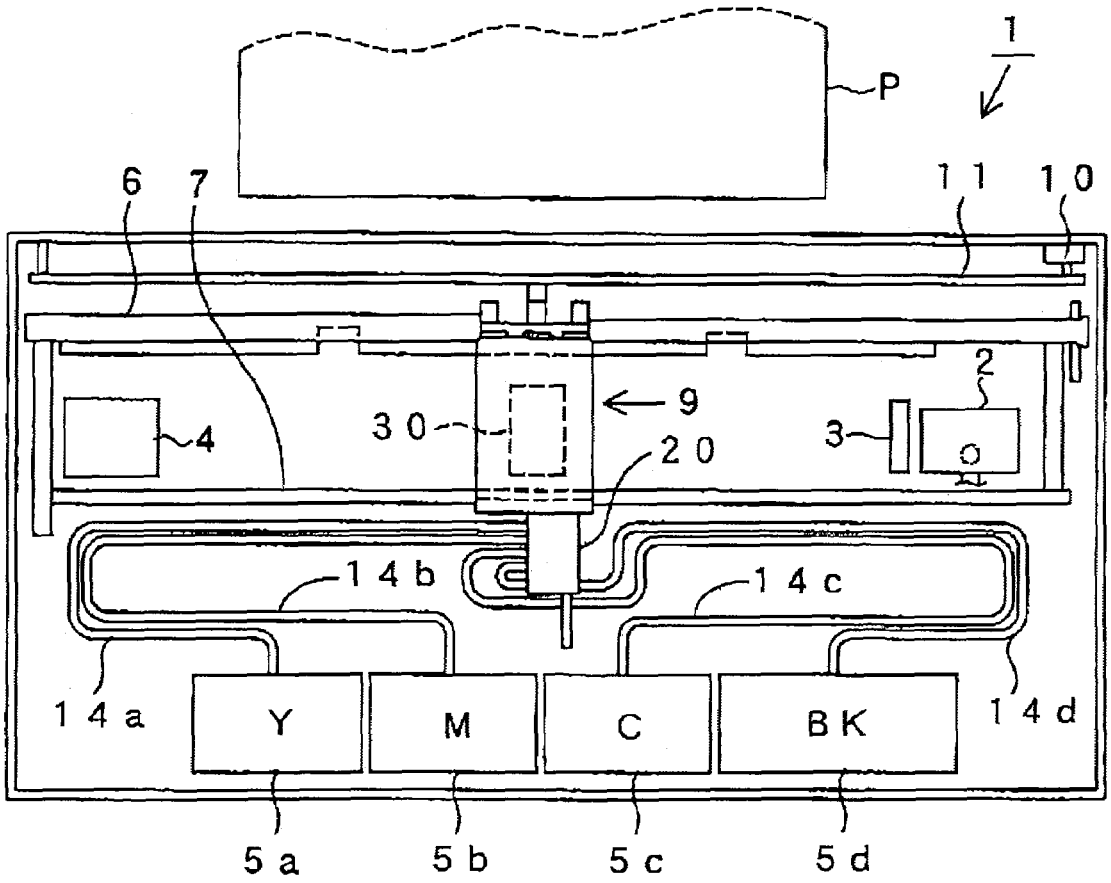
FIG. 1 is a schematic plan view of an inkjet recording apparatus according to a first embodiment of the invention.

Initially, a general structure of the inkjet recording apparatus is described with reference to FIG. 1, which is a schematic plan view of the inkjet recording apparatus.

In the inkjet recording apparatus, which is generally denoted by reference numeral 1, are disposed two guide rods 6, 7 opposite each other. To the guide rods 6, 7 is attached a head holder 9 which serves as a carriage as well as a holder if an inkjet recording head 30 that performs recording of an image on a recording sheet P by ejecting ink droplets therefrom onto the recording sheet P. The recording head 30 includes a mainbody having a plurality of nozzles, a plurality of ink passages communicated with the respective nozzles, and an actuator unit 32 for applying energy for ejecting ink droplets. In this specific example, a piezoelectric actuator unit using a plurality of piezoelectric elements is employed as the actuator unit 32, and the actuator unit 32 partially defines the ink passages.

In the mainbody, a row of nozzles for each of black, yellow, cyan and magenta ink is formed. More specifically, a black ink nozzle row consisting of a plurality of nozzles from which black ink is to be ejected in the form of droplets, an yellow ink nozzle row consisting of a plurality of nozzles from which yellow ink is to be ejected in the form of droplets, a cyan ink nozzle row consisting of a plurality of nozzles from which cyan ink is to be ejected in the form of droplets, and a magenta ink nozzle row consisting of a plurality of nozzles from which magenta ink is to be ejected in the form of droplets, are arranged to be open in a nozzle surface of the mainbody of the recording head 30. The recording head 30 is disposed such that the openings of the nozzles are opposed to a recording surface of the recording sheet P as having been supplied into the inkjet recording apparatus, with a predetermined clearance therebetween. The recording surface of the recording sheet P is a surface on which an image is to be recorded.

The head holder 9 is coupled with an endless belt 11 that is circulated by a carriage motor 10. That is, the head holder 9 reciprocates along the guide rods 6, 7 and in a scanning direction, by being driven by the carriage motor 10.

The inkjet recording apparatus 1 further includes four ink tanks 5*a*, 5*b*, 5*c*, 5*d* for respective colors, namely, yellow, magenta, cyan and black. A tube joint 20 is attached to the recording head 30, and the ink tanks 5*a*-5*d* are connected to the tube joint 20 via respective flexible tubes 14*a*, 14*b*, 14*c*, 14*d* so that the ink tanks 5*a*-5*d* are connected to the recording head 30 via the tube joint 20. The color inks accommodated in the ink tanks 5*a*-5*d* are supplied to respectively corresponding ink passages formed in the recording head 30.

At a left end of a range of reciprocation of the head holder 9, an absorber 4 for absorbing bad ink discharged from the recording head 30 through the nozzles in a flushing operation. On the other hand, at a right end of the range of reciprocation of the head holder 9 is disposed a purge unit 2 that sucks bad ink in the recording head 30 through the nozzles in a purging operation. To the left of the purge unit 2, a wiper 3 for wiping off the ink adhering to the nozzle surface of the recording head 30 is disposed.

[General Structure of a Control System of the Inkjet Recording Apparatus]

Figure 2:
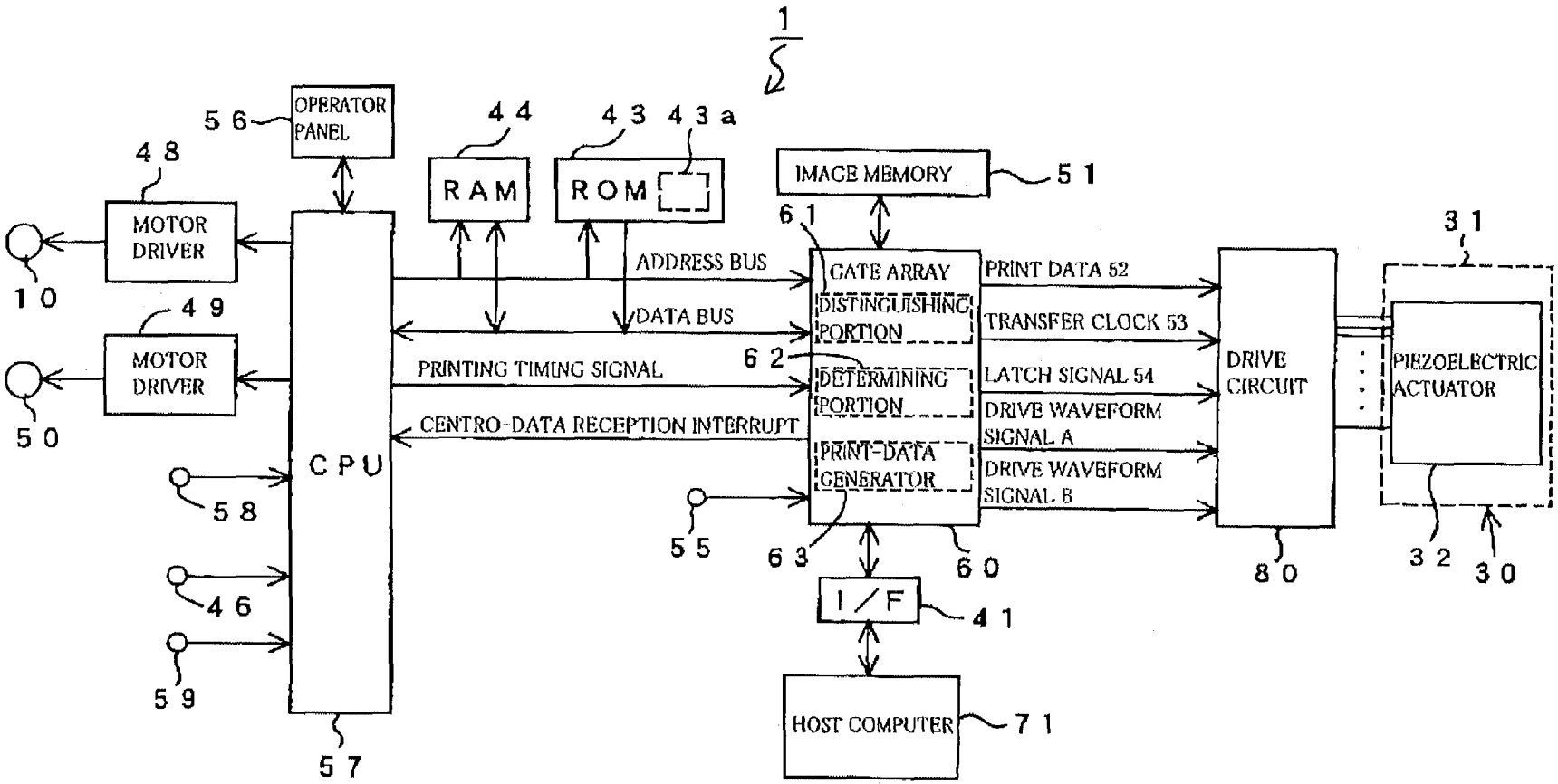
FIG. 2 is a block diagram of a control system of the inkjet recording apparatus.

There will be now described a general structure of a control system of the inkjet recording apparatus 1, with reference to a block diagram of FIG. 2.

The inkjet recording apparatus 1 includes a CPU 57 and a gate array 60. The CPU 57 implements various principal controls necessary for recording. For instance, the CPU 57 issues instructions on a printing operation to a drive circuit 80, implements a print control as described later, outputs a maintenance instruction such as that of the flushing and purging operations. The gate array 60 controls to receive print data transmitted from a host computer 71 via an interface (I/F) 41, decode the print data, and store the decoded print data in an image memory 51. To the CPU 57 and the gate array 60 are connected a ROM 43 and a RAM 44, via an address bus and a data bus.

The ROM 43 includes a storage area 43*a* in which a drive waveform signal is stored. The drive circuit 80 produces a drive signal based on the drive waveform signal, and outputs the drive signal to the piezoelectric actuator unit 32 to drive the piezoelectric actuator unit 32. In this specific example, the storage area 43*a* stores a drive waveform signal A for ejecting three ink droplets in series for printing one dot, and a drive waveform signal B for ejecting one ink droplet for printing one dot.

The rest of an entire storage area of the ROM 43 other than the storage area 43*a* is used for storing a computer program according to which the CPU 57 implements a print control (described later), and others. The RAM 44 temporarily stores various kinds of data that the gate array 60 has received from the host computer 71, a result of processing by the CPU 57, and others.

To the CPU 57 are connected various devices such as a recording medium sensor 58 for detecting a recording sheet P set in a supply tray, an origin sensor 46 for detecting the recording head 30 located at a home position, a temperature sensor 59 for measuring a temperature of an environment in which the inkjet recording apparatus 1 is situated, a motor driver 48 for driving the carriage motor 10, a motor driver 49 for driving a line-feed motor or a LF motor 50, and an operator panel 56 through which various kinds of signals are inputted to the CPU 57.

To the gate array 60 is connected the image memory 51 that receives the print data from the host computer 71. The gate array 60 temporarily stores the print data as image data.

The gate array 60 includes a distinguishing portion 61 that determines whether or not an image to be printed is a barcode, a determining portion 62 that determines whether there is a dot to be printed immediately before and after each one of dots to be sequentially printed in the main scanning direction, and a print-data generator 63 that generates, based on a result of the determination made by the determining portion, two kinds of print data according to which printing is performed. One of the two kinds is for performing printing according to a drive waveform signal A, and the other kind is for performing printing according to a drive waveform signal B.

Figure 4:
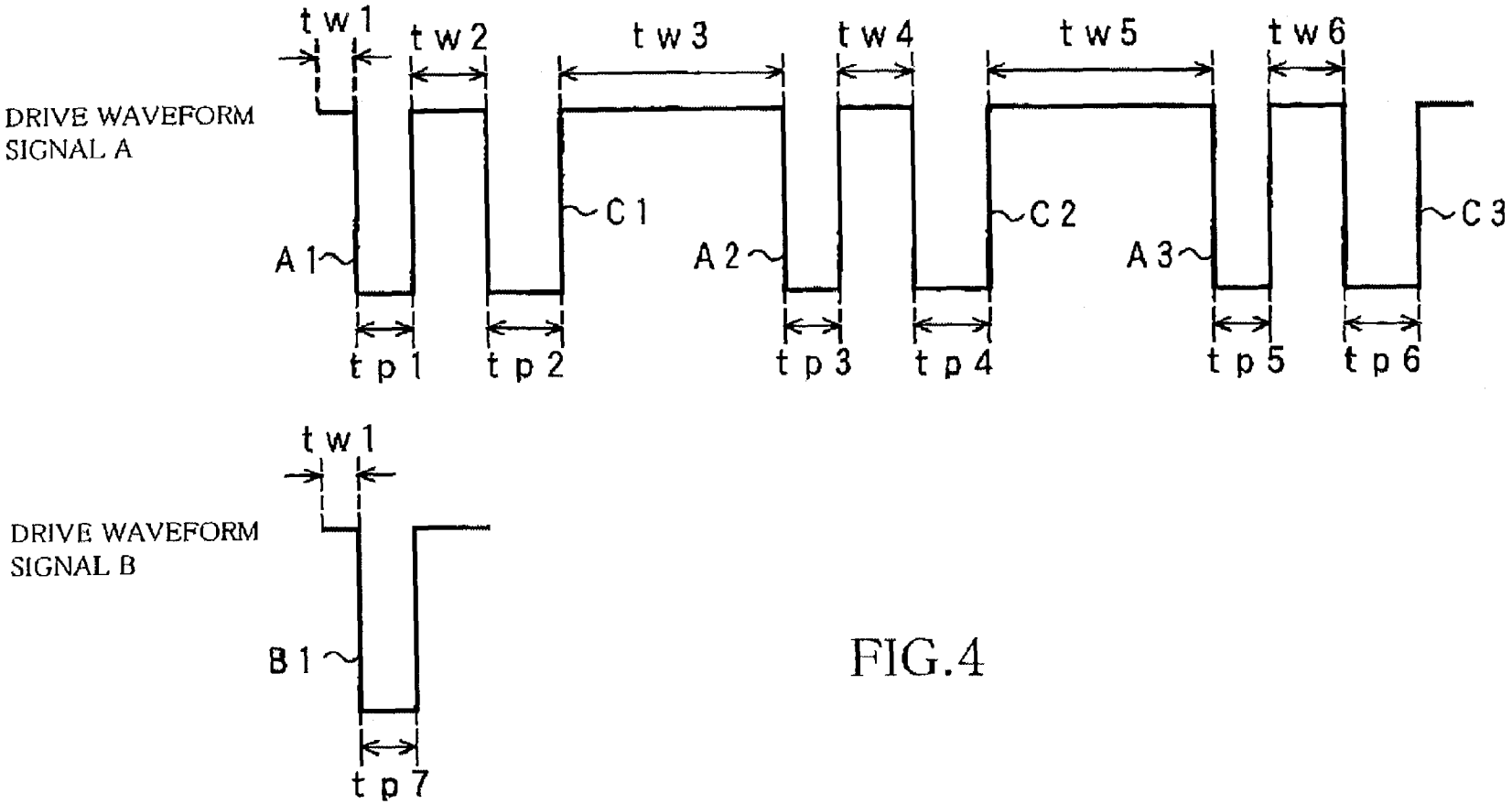
FIG. 4 is a chart illustrating drive waveform signals A and B.

As shown in FIG. 4, the drive waveform signal A is for forming one dot by ejecting three ink droplets onto the recording sheet P, for print data corresponding to one dot. On the other hand, the drive waveform signal B is for forming one dot by ejecting one ink droplet for print data corresponding to one dot. The print data for selecting each of the drive waveform signals A and B is of two bits, i.e., "01" and "10", respectively. Another print data "00" represents that a dot is not to be printed, and hereinafter referred to as "non-print data".

[General Structure of the Drive Circuit]

Figure 3:
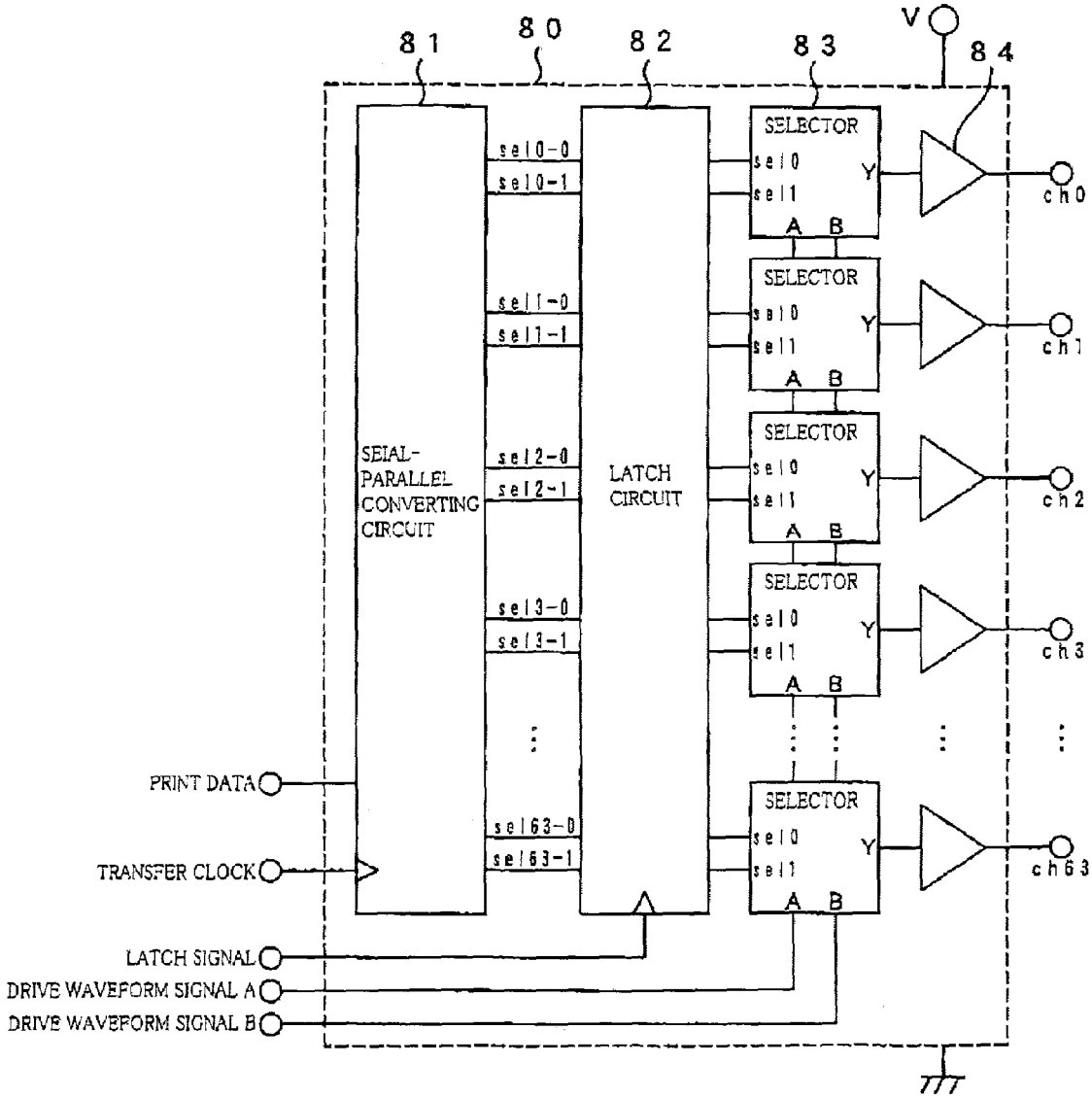
FIG. 3 is a block diagram of a drive circuit shown in FIG. 2.

There will be next described a general structure of the drive circuit 80, by referring to a block diagram of FIG. 3. In this specific example, channels of, or the ink passages formed in, the recording head 30 total 64, and are respectively denoted by reference symbols ch0-ch63.

The drive circuit 80 includes a serial-parallel converting circuit 81, a latch circuit 82, selectors 83 provided for the respective channels, and drivers 84 provided for the respective channels. The serial-parallel converting circuit 81 is constituted by a shift register of 64-bit length, and converts print data 52, which is serially transferred from the gate array 60 (shown in FIG. 2) in synchronization with a transfer clock 53, into parallel data. More specifically, at each raising edge of the transfer clock 53, the serial print data is converted into the parallel data. That is, the print data 52 generated by the print data generator 63 for each of the 64 channels is set as a selecting signal of two bits (sel-0, and sel-1) for each channel.

The latch circuit 82 latches the parallel data outputted from the serial-parallel converting circuit 81 in synchronization with a latch signal 54 transferred from the gate array 60, namely, latches at each rising edge of the latch signal 54. Each of the 64 selectors 83 provided for the respective channels makes a selection, based on the parallel print data outputted from the latch circuit 82, among a plurality of kinds of drive waveform signals that are transferred from the gate array 60, and outputs the selected one of drive waveform signal. In this example, the plurality of kinds of drive waveform signals is two kinds thereof, i.e., the drive waveform signal A and the drive waveform signal B, as mentioned above.

The drive waveform signals A, B stored in the storage area 43*a* of the ROM 43 are kept outputted in a cycle from the gate array 60 to the selector 83, and provide by themselves ejection timing signals. According to the values of sel-0, sel-1 as the print data that is inputted to the selector 83, one of the drive waveform signals is selected. When the value of both of sel-0 and sel-1 is 0, namely, when the input print data is 0, 0, a dot is not to be printed. When the values of sel-0 and sel-1 are 0 and 1, the drive waveform signal A is selected, and when the values of sel-0 and sel-1 are 1 and 0, the drive waveform signal B is selected. In this way, the print data of each waveform is provided by data of two bits, so that one of the drive waveform signal A and the drive waveform signal B is selected for each nozzle.

Each of the 64 drivers 84 transforms the drive waveform signal outputted from a corresponding one of the selectors 83, into the drive signal at a voltage suitable for driving the recording head 30, and outputs the drive signal to a corresponding one of electrodes respectively connected to the piezoelectric elements of the actuator unit 32.

[Structure of the Drive Waveform Signals]

There will be now described the drive waveform signals A and B, with reference to FIG. 4. As shown in FIG. 4, the drive waveform signal A includes three printing pulses A1-A3 for ejecting three ink droplets for print data corresponding to one dot, and cancelling pulses C1-C3 for cancelling the remaining change in ink pressure in the ink passage after ejection of the respective three ink droplets. On the other hand, the drive waveform signal B includes one printing pulse B1 for ejecting one ink droplet for print data corresponding to one dot.

A pulse width of a first one Al of the printing pulses A1-A3 of the drive waveform signal A, that is, an ON time during which the voltage is applied to the electrode according to the first printing pulse A1, is tp1. It is noted that in FIG. 4 each low portion of the drive waveform signal A, B corresponds to the ON time. When a time period tw2 has elapsed from a rising edge of the first printing pulse A1, in other words, from a moment the application of the voltage for the first printing pulse A1 is terminated, the voltage is applied as a first cancelling pulse C1 having a pulse width or time duration of tp2 in order to cancel the change in ink pressure remaining in the ink passage and caused by the application of the first printing pulse A1. When a time period tw3 has elapsed from a rising edge of the first cancelling pulse C1, i.e., from a moment the application of the voltage as the first cancelling pulse C1 is terminated, a second printing pulse A2 having a pulse width or time duration of tp3 is applied. When a time period tw4 has elapsed from a rising edge of the second printing pulse A2, i.e., from a moment the application of the voltage as the second printing pulse A2 is terminated, a second cancelling pulse C2 having a pulse width or time duration of tp4 is applied in order to cancel the change in ink pressure remaining in the ink passage and caused by the application of the second printing pulse A2. When a time period tw5 has elapsed after a rising edge of the second cancelling pulse C2, i.e., from a moment the application of the voltage as the second cancelling pulse C2 is terminated, a third printing pulse A3 having a pulse width or time duration of tp5 is applied. When a time period tw6 has elapsed after a rising edge of the third printing pulse A3, i.e., after a moment the application of the third printing pulse A3 is terminated, a third cancelling pulse C3 having a pulse width or time duration of tp6 is applied in order to cancel the change in ink pressure remaining in the ink passage and caused by the application of the voltage as the third printing pulse A3. A time period tw1 before application of the printing pulse A1 is a standby time between two printing timings. An ON time of the printing pulse B1 of the drive waveform signal B is tp7.

For instance, the time periods tw1-6 and the pulse widths tp1-6 of the drive waveform signal A may take the following values, respectively: tw1=3.067 (in units of 0.133 microseconds, the same applies hereinafter), tp1=6.533, tw2=9.067, tp2=8.533, tw3=24.000, tp3=6.533, tw4=9.067, tp4=8.533, tw5=24.000, tp5=6.533, tw6=9.067, and tp6=8.533. On the other hand, the pulse width tp7 of the printing pulse B1 of the drive waveform signal B may be 3.067.

[Flow of the Print Control]

Figure 5:
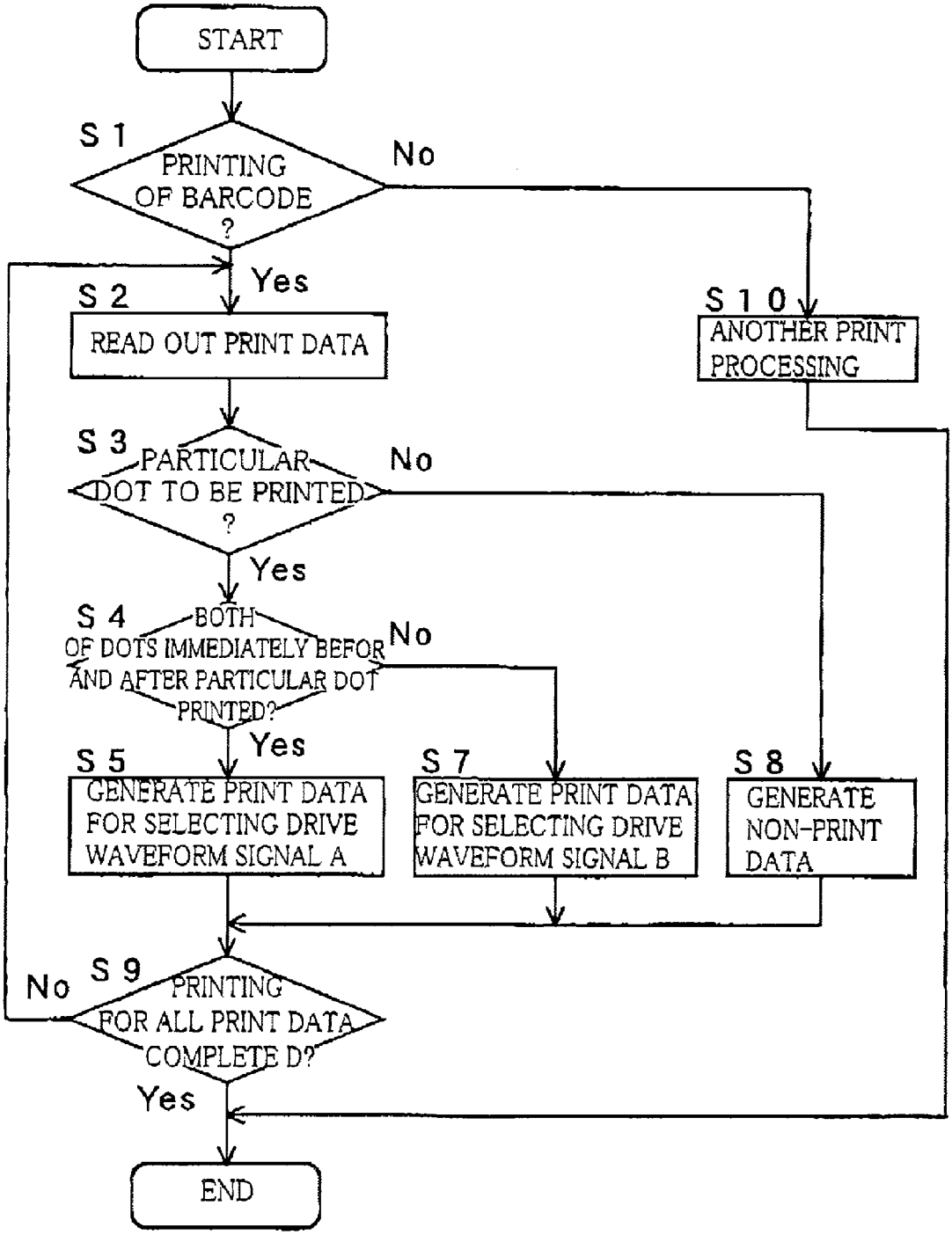
FIG. 5 is a flowchart of a print control according to the first embodiment.
Figure 7A:
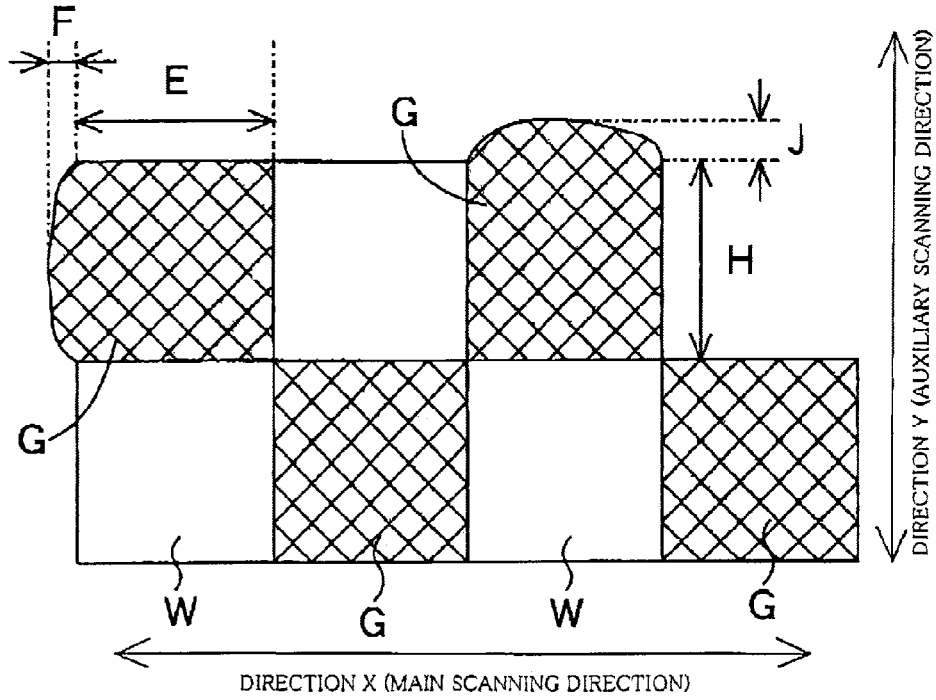
FIG. 7A is a schematic diagram showing a part of a two-dimensional barcode.
Figure 7B:
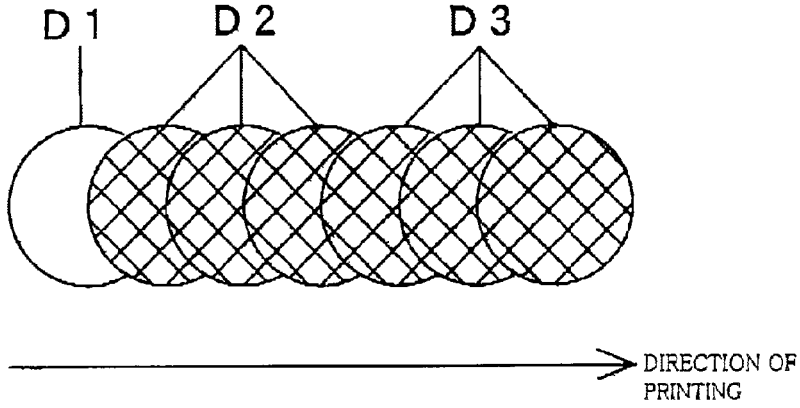
FIG. 7B is a schematic diagram showing dots printed at an edge portion of the two-dimensional barcode.

There will be described a flow of the print control implemented by the control system shown in FIG. 2, with reference to FIGS. 5 and 7A-7C. FIG. 5 is a flowchart illustrating a flow of the print control, FIG. 7A is a schematic diagram showing a part of a two-dimensional barcode, and FIG. 7B is a schematic diagram showing dots formed at an edge portion of the two-dimensional barcode.

When initiation of printing based on a piece of image data is instructed, the print control is initiated in step S1 in which the distinguishing portion 61 determines whether the image data piece is of a barcode, or of another kind of image than barcode, based on which determination a suitable printing mode is selected. The determination is made based on an instructional signal included in data received via the interface 41, or inputted through the operator panel 56 by the operator. When the recording apparatus is adapted such that the print control for adjusting dots at an outline of an image is implemented in printing of an image that is not a barcode, in the same way as in printing of a barcode, the determination of step S1 is omitted. When a negative decision (NO) is made in step S1, that is, when it is determined that an image that is not a barcode is to be printed, the control flow goes to step S10 to implement print processing not under the dot adjustment of the present embodiment and similar to that known in the art, and the control flow terminates. Since the print processing of step S10 is not relevant to this invention, the description thereof is not provided.

When an affirmative decision (YES) is obtained in step S1, that is, when a barcode is to be printed, the control flow goes to step S2 in which the gate array 60 shown in FIG. 2 reads out print data transferred from the host computer 71 and stored in the image memory 51. The control flow then goes to step S3 in which the gate array 60 determines whether the print data for a particular dot includes data instructing printing of the particular dot. When an affirmative decision (YES) is made in step S3, that is, when the particular dot is a dot to be printed, the control flow goes to step S4 in which the determining portion 62 of the gate array 60 determines whether a dot has been printed in a cycle of the print control immediately before the current cycle for the particular dot and a dot is to be printed in a cycle of the print control immediately after the current cycle. In other words, it is determined whether both of two dots adjacent the particular dot in the main scanning direction of the recording head 30 are to be printed or not. When a negative decision is made in step S4, that is, when at least one of the two dots immediately before and after the particular dot is/are not printed or not to be printed, the control flow goes to step S7 in which the print-data generator 63 generates the print data "10" that instructs to select the drive waveform signal B. On the other hand, when an affirmative decision (YES) is made in step S4, that is, when both of the dots immediately before and after the particular dot are printed and to be printed, the control flow goes to step S5 in which the print-data generator 63 generates the print data "01" that instructs to select the drive waveform signal A. Meanwhile, when a negative decision is made in step S3, that is, it is determined that the particular dot is a dot not to be printed, the control flow goes to step S8 in which the print-data generator 63 generates the non-print data "00".

The print data 01, 10 or the non-print data 00 is outputted to the serial-parallel converting circuit 81, so that the selecting signal sel-0, sel-1 is set for each of the ink passages. Each of the selectors 83 selects one among the drive waveform signals A, B and the non-print data that are transferred from the gate array 60, based on the parallel print data outputted from the latch circuit 82, and outputs the selected print data or non-print data to the driver 84. Then, one ink droplet or three ink droplets is/are ejected according to the selected print data from each of the pertinent ink passages.

For instance, when the recording head 30 is to print a front edge and a rear edge, in the main scanning direction, of a two-dimensional barcode as one form of barcode, the drive waveform signal B is selected. Hence, a leftmost dot D1 shown in FIG. 7B, which corresponds to the dot at the front edge of the two-dimensional barcode, is formed of a single ink droplet, and the same applies to the rightmost dot (not shown) in the two-dimensional barcode. On the other hand, when an inner portion, with respect to the main scanning direction, of the two-dimensional barcode is to be printed after a first dot or a dot at the front edge, in the main scanning direction, of the two-dimensional barcode, has been printed, the drive waveform signal A is selected for each of the dots subsequent to the first dot, except the last dot or the dot at the rear edge, in the main scanning line, of the two-dimensional barcode. Hence, in the inner portion of the two-dimensional barcode, one dot D2, D3 is formed with three ink droplets, as shown in FIG. 7B.

When all the dots to be printed in the barcode have been printed, it is determined in step S9 following each of the steps S5, S7, S8 that there is no more print data based on which printing is to be implemented, and the print control terminates.

Experiment

Figure 9A:
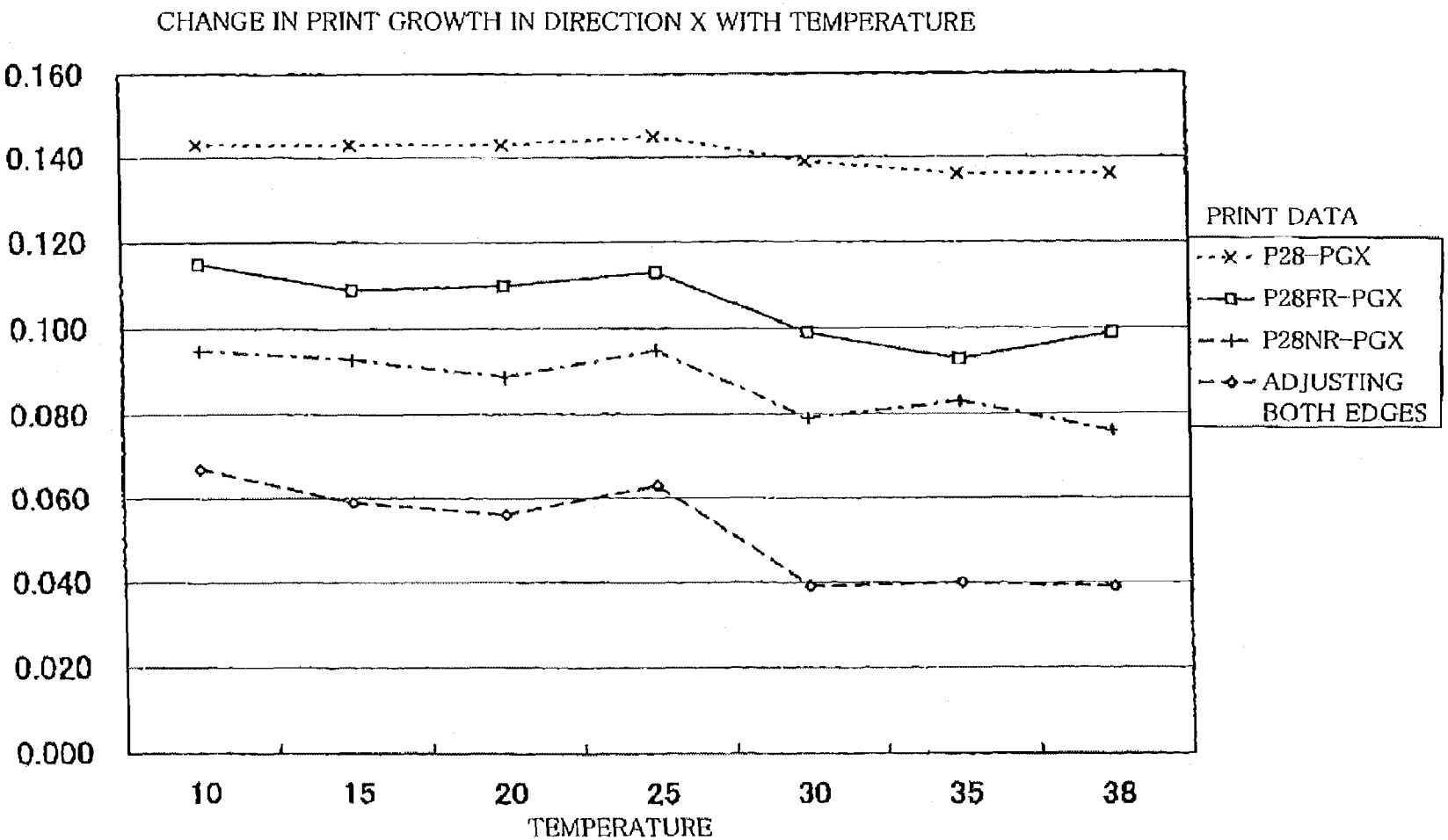
FIGS. 9A and 9B shows the result in graphs.
Figure 9B:
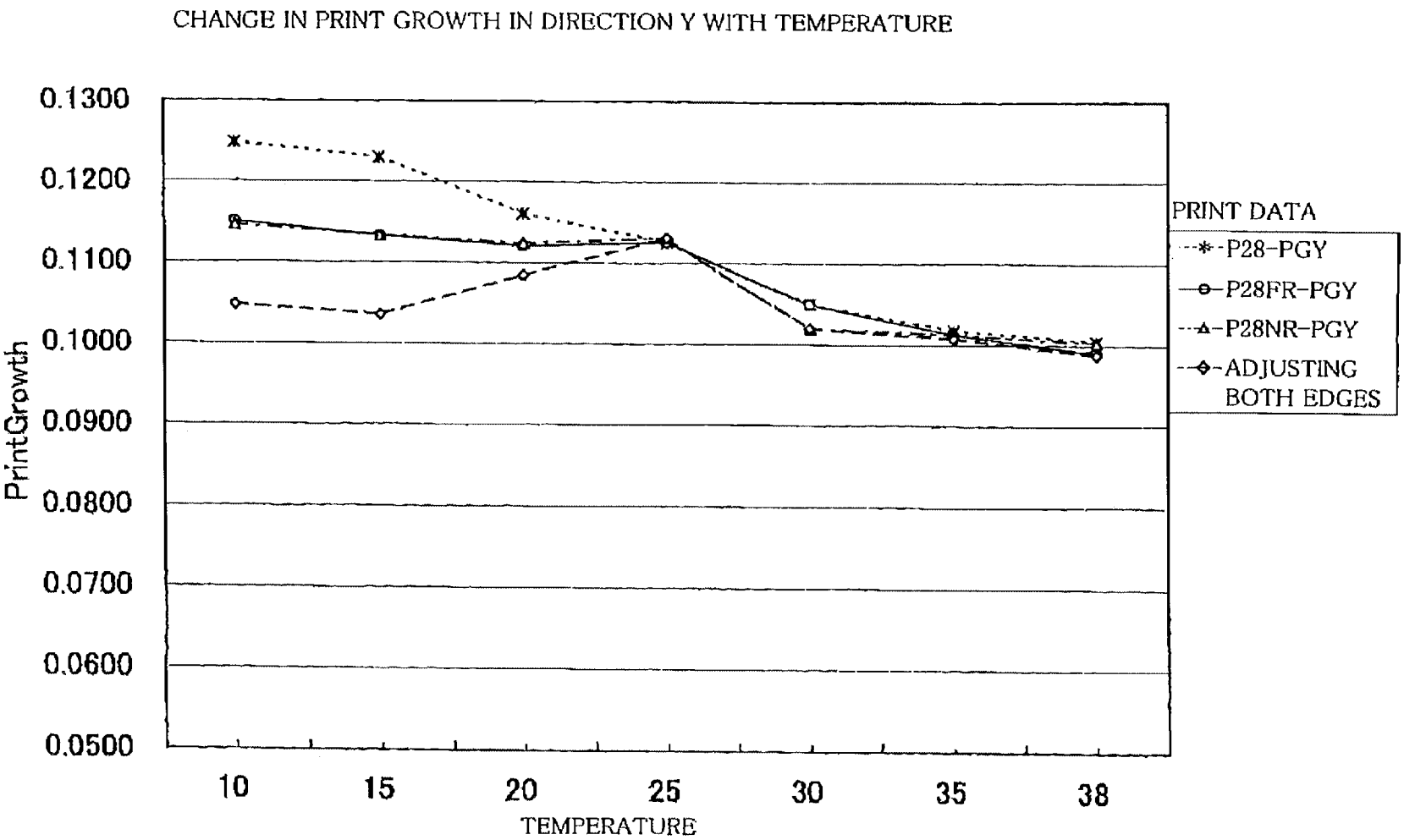

There will be described an experiment conducted by the present inventor, by referring to FIGS. 8, 9A and 9B. FIG. 8 is a table showing a result of the experiment, and FIGS. 9A and 9B show the result in graphs.

The present inventor measured change in the growth of a two-dimensional barcode (hereinafter referred to as "print growth") with the environmental temperature, for various drive signals. As shown in FIG. 7A, the two-dimensional barcode is formed of a matrix of black cells G and white cells W that are foursquare. More specifically, the print growth is an amount in which a black cell G grows, or an amount in which the ink forming the black cell G spreads, at an edge of the black cell G when the two-dimensional barcode is printed. The print growth in a direction X, which corresponds to the main scanning direction, is calculated as F/E, and a print growth in a direction Y, which corresponds to the auxiliary scanning direction, is calculated as J/H, where E and H respectively represent a width and a height of a black cell G shown in FIG. 7A, F represents a width of the growth of the ink in the direction X, i.e., an amount of spreading of the ink from an edge of the black cell G in the main scanning direction, and J represents a width of the growth of the ink in the direction Y, i.e., an amount of spreading of the ink from an edge of the black cell G in the auxiliary scanning direction. Hence, the value of the print growth decreases with decrease in the amount of spreading of the ink at the edge of the black cell G.

In the table of FIG. 8, "P28" in the first half of the names of two of all the sorts of drive signals represents that for that drive signal, each of all the dots was formed by ejecting a same volume of an ink droplet, namely, an ink droplet of 28 pl, using a same drive waveform signal. "P28FR" in the first half of the names of another two of all the sorts of drive signals represents that (a) when the dot immediately before a particular dot to be printed was not printed, but the dot immediately after the particular dot was to be printed, the drive waveform signal was switched to another so that the particular one dot was formed by ejecting one ink droplet of 28 pl in volume, and (b) in other cases, one dot was formed by ejecting three ink droplets in series, with each ink droplet being 28 pl in volume. "P28NR" in the frst half of the names of another two of all the sorts of drive signals represents that (c) when the dot immediately before a particular dot to be printed was printed, but the dot immediately after the particular dot was not to be printed, the drive waveform signal was switched to another so that the particular one dot was formed by ejecting one ink droplet of 28 pl in volume, and (d) in other cases, one dot was formed by one dot was formed by ejecting three ink droplets in series, with each ink droplet being 28 pl in volume.

"PGX" in the latter half of the names of three of all the sorts of drive signals represents that the data or value is of print growth in the direction X or the main scanning direction, and "PGY" represents that the value is of print growth in the direction Y or the auxiliary scanning direction For instance, print growth values of both of "P28-PGX" and "P28FR-PGX" were values of the print growth in the direction X measured in such a manner that only one dot at each of the opposite edges, in the direction X, of the black cell G was formed of one ink droplet in 28 pl in volume, and each of the other dots in the black cell G is formed of three ink droplets each in 28 pl in volume and ejected in series.

The print growth value was obtained for each of the following values of environmental temperature, for each of the drive signal: 10, 15, 20, 25, 30, 35 and 38° C.

It is noted that the print growth value for the drive signal for adjusting both of the opposite edges in the main scanning direction, as presented in FIGS. 9A and 9B, was calculated as follows: P28FR-PGX+P28NR-PGX−P28-PGX, or P28FR-PGY+P28NR-PGY−P28-PGY.

When the black cell G was printed using the drive signal P28, the print growth in the direction X took a maximum value 0.145 when the environmental temperature was 25° C., and a minimum value 0.136 when the environmental temperature was 35 and 38° C. With regard to the direction Y, the print growth took a maximum value 0.1248 when the environmental temperature was 10° C., and a minimum value 0.1005 when the environmental temperature was 38° C.

When the black cell G was printed using the drive signal P28FR, the print growth in the direction X took a maximum value 0.115 when the environmental temperature was 10° C., and a minimum value 0.093 when the environmental temperature was 35° C. With regard to the direction Y, the print growth took a maximum value 0.1150 when the environmental temperature was 10° C., and a minimum value 0.0990 when the environmental temperature was 38° C.

That is, when printing of the black cell G was implemented such that only an initial one dot in the black cell G in the main scanning direction was formed of one ink droplet and the following dots were formed by ejecting three ink droplets in series for each dot, the print growth was reduced with respect to both of the directions X and Y, compared to the case where all the dots in the black cell were formed by ejecting three ink droplets for one dot. More specifically, the print growth was reduced down to 0.115 or thereunder with respect to the direction X, and down to 0.1150 or thereunder with respect to the direction Y.

When the black cell G was printed using the drive signal P28NR, the print growth in the direction X took a maximum value 0.095 when the environmental temperature was 10 and 25° C., and a minimum value 0.076 when the environmental temperature was 38° C. With regard to the direction Y, the print growth took a maximum value 0.1146 when the environmental temperature was 10° C., and a minimum value 0.1003 when the environmental temperature was 38° C.

That is, when printing of the black cell G was implemented such that only a last dot in the black cell G in the main scanning direction was formed of one ink droplet, and the preceding black dots in the same direction were formed by ejecting three ink droplets in series for one dot, the print growth was reduced in the direction X, compared to the case where all the dots in the black cell G were printed by ejecting three ink droplets for one dot. More specifically, the print growth was reduced down to 0.095 or thereunder with respect to the direction X.

Hence, by forming with one ink droplet the dot at each of the two opposite edges, in the scanning direction, of the black cell G, the size of the black cell can be controlled with high accuracy and precision. It is noted that to obtain this effect, the dot at only one of the two opposite edges of the black cell G may be formed of one ink droplet.

Effects of the First Embodiment (1) As described above, when a two-dimensional barcode is recorded using the inkjet recording apparatus 1, each of the black cells G in the two-dimensional barcode are printed such that (i) when a particular dot in the black cell G is to be printed immediately before or after which a dot is not printed, that is, when a dot at each of the front and rear edges, in the main scanning direction, of the black cell G is to be printed, the drive waveform signal B for ejecting one ink droplet for one dot is outputted to the piezoelectric actuator unit 32 so that the particular dot is formed with one ink droplet, and (ii) when a particular dot in the black cell G is to be printed immediately before or after which a dot is printed, that is, when a dot on the inner side of the front and rear edges of the black cell G is to be printed, the drive waveform signal A for ejecting three ink droplets for one dot is outputted to the piezoelectric actuator unit 32 so that the particular dot is formed with three ink droplets.

That is, according to the inkjet recording apparatus 1, the number of ink droplets ejected for forming one dot is decreased at an edge, in the main scanning direction, of each black cell in the barcode. Thus, compared to the conventional inkjet recording apparatus where the volume of one ink droplet is decreased to adjust the dot at the edge, the apparatus 1 can accurately control the shape, size and density of the dot at the edge of the black cell G, restraining the enlargement of the dot.

(2) The drive waveform signal A and the drive waveform signal B are stored in the storage area 43*a* of the ROM 43, so that the drive waveform signal B is selected and used when a dot on an outline, or at an edge, of the black cell G is to be printed, and the drive waveform signal A is selected and used when a dot not on the outline, or not at the edge, of the black cell G is to be printed. That is, drive signals corresponding to the respective numbers of ink droplets to be ejected is employed to drive the piezoelectric actuator unit 32, thereby enabling to accurately control the shape, size and density of the dot printed.

(3) Even when the ink ejection characteristic of the recording head 30 varies from head to head due to individual specificity in the flow resistance of the ink passage and others, drive signals corresponding to the specificity of each recording head 30 can be stored, if necessary, in the storage area 43*a* to eliminate an adverse influence of the variation in the ink ejection characteristic from head to head.

(4) The distinguishing portion 61 determines whether the image instructed to print is a barcode or not, and when it is determined that the image to be printed is a barcode, a selection between the drive waveform signal A and the drive waveform signal B is made.

As described above, a barcode printed using the inkjet recording apparatus 1 is improved in the print quality at the outline or edge thereof, and a barcode that will not be misread can be obtained.

It is noted that the principle of this embodiment is applicable to dots printed or arranged in series in the auxiliary scanning direction, as only briefly mentioned above with respect to FIG. 7A, and the effects of the first embodiment can be enjoyed with respect to the auxiliary direction, too. More specifically, when a dot at one of the opposite ends of a line of dots printed in series in the auxiliary direction, or of a column of dots extending in the auxiliary direction, in the black cell G is formed by a smaller number of ink droplet or droplets than that the other dots on the inner side of the column are formed by, as the publication 4 discloses in FIGS. 10-15, 20, the shape, size and density of the dot at the edge in the auxiliary direction can be accurately controlled, thereby restraining the enlargement of the black cell G in the auxiliary direction. In this case, the term "immediately before the particular dots" and "immediately after the particular dot" or the like means that "immediately before the particular dot in the auxiliary direction" and "immediately after the particular dot in the auxiliary direction".

Second Embodiment

Figure 6:
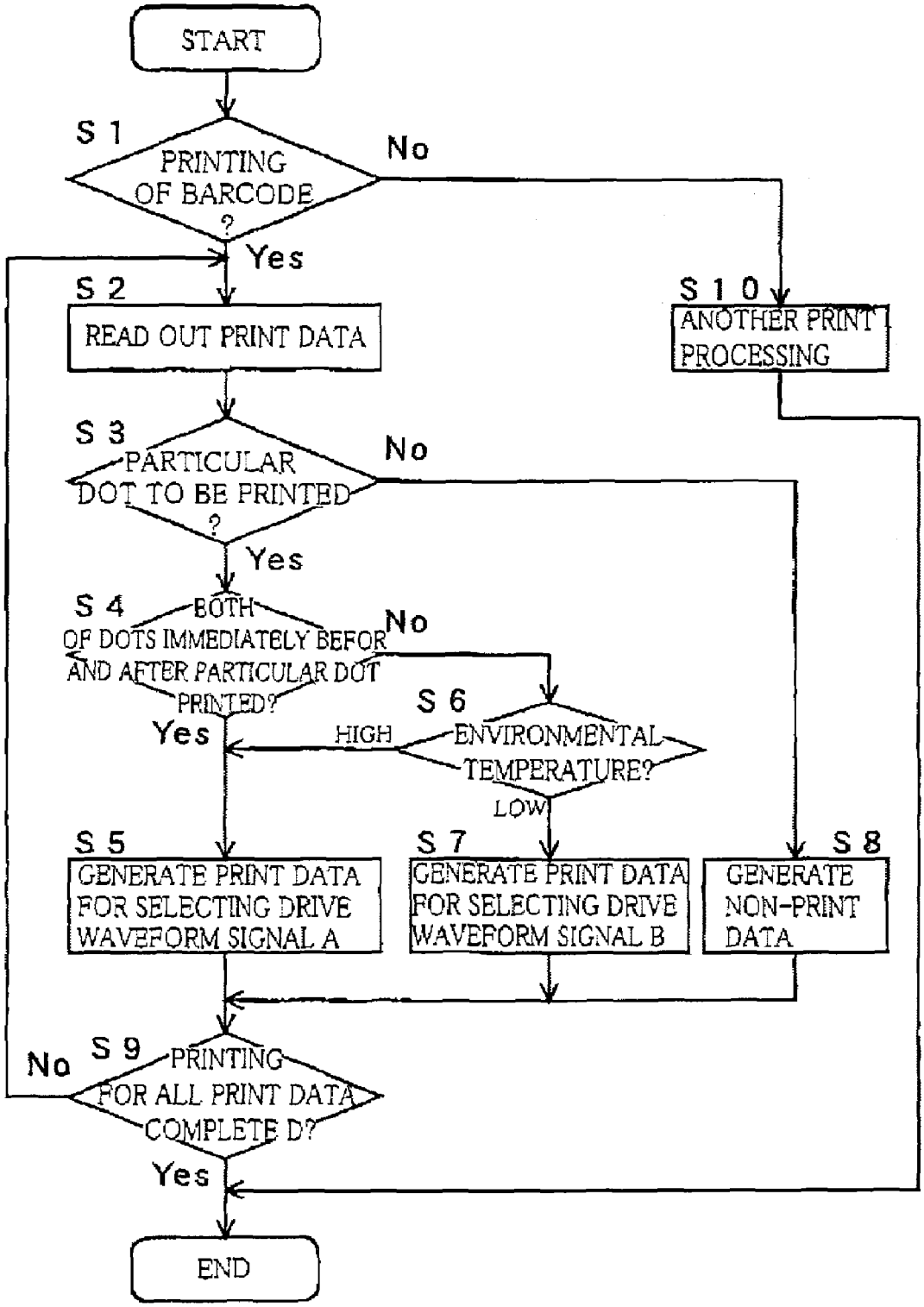
FIG. 6 is a flowchart of a print control according to a second embodiment of the invention.

There will be now described an inkjet recording apparatus according to a second embodiment of the invention, with reference to FIG. 6.

The inkjet recording apparatus of the second embodiment is characterized by being capable of performing high-quality printing by taking account of change in the viscosity of the ink depending on the environmental temperature.

FIG. 6 is a flowchart illustrating a print control implemented in the inkjet recording apparatus according to the second embodiment. Only a part of the print control differs from that of the inkjet recording apparatus according to the first embodiment, and except which the structure and function of the apparatus of the second embodiment is identical with the apparatus of the first embodiment. Hence, the elements or parts corresponding to those of the first embodiment will be denoted by the same reference symbols or numerals and description there of is omitted or only briefly illustrated.

According to the experiment conducted by the present inventor and having been described above by referring to FIG. 8, when dots are printed sequentially in the main scanning direction while the environmental temperature is relatively low and accordingly the viscosity of the ink is relatively high, the ink forming the printed dots tends to spread more greatly than while the environmental temperature is relatively high.

One of the reasons for this can be that when the ink viscosity is increased with decrease in the ink temperature, and one dot is formed with a plurality of ink droplets, the landing positions of the ink droplets do not coincide, making the dot enlarge in the main scanning direction.

Then, the inventor has developed an arrangement where the print quality does not lower at the edge of the black cell G irrespective of change in the environmental temperature, by selecting an appropriate one of a plurality of sorts of drive signals depending on the current environmental temperature.

That is, when a dot is not printed immediately before a particular dot to be printed, it is determined whether the environmental temperature is higher than a threshold. When the environmental temperature is higher than the threshold, the particular dot is formed by three ink droplets. When the environmental temperature is not higher than the threshold, the particular dot is formed by one ink droplet.

A temperature sensor 59 (shown in FIG. 2) outputs a signal corresponding to the current value of the environmental temperature to the CPU 57, which then calculates the value of the environmental temperature based on the signal from the temperature sensor 59. The thus obtained value of the environmental temperature is stored in a RAM 44.

Steps S1-S4 of the print control according to the second embodiment as shown in FIG. 6 are identical with those steps of the first embodiment shown in FIG. 5. When a determining portion 62 determines in step S4 that a dot is not printed or not to be printed in a cycle of the print control immediately before or after the current cycle to print a particular dot, that is, when a negative decision (NO) is made in step S4, the control flow goes to step S6 to reference the value of the environmental temperature stored in the RAM 44 and determines whether the current value of the environmental temperature is higher than a predetermined threshold (e.g., 21.3° C.). When it is determined in step S6 that the value of the environmental temperature is higher than the threshold, the control flow goes to step S5 in which a print-data generator 63 generates print data for selecting a drive waveform signal A. On the other hand, when it is determined in step S6 the value of the environmental temperature is not higher than the threshold, the control flow goes to step S7 in which the print-data generator 63 generates print data for selecting a drive waveform signal B.

That is, when the particular dot to be printed is at the edge of the black cell G and the environmental temperature is higher than the threshold, three ink droplets are ejected according to the drive waveform signal A to form the particular dot. On the other hand, when the particular dot to be printed is at the edge of the black cell G but the environmental temperature is not higher than the threshold, one ink droplet is ejected according to the drive waveform signal B to form the particular dot.

Effects of the Second Embodiment (1) As described above, in the inkjet recording apparatus of the second embodiment, when a dot at an edge of a black cell G in the main scanning direction is to be printed while the environmental temperature is not higher than the threshold, the drive waveform signal B is selected to eject one ink droplet for forming the dot at the edge, thereby reducing the amount of spreading of the ink in the main scanning direction at the edge of the black cell G.

That is, even where a dot is not to be printed immediately before and/or after the particular dot to be printed, a plurality of ink droplets are ejected to form the particular dot when the environmental temperature is higher than the threshold. On the other hand, when the environmental temperature is not higher than the threshold, an ink droplet or droplets in a number smaller than the number of ink droplets ejected in the case where the environmental temperature is higher than the threshold is/are ejected to form the particular dot Hence, a total amount of the volume of the ink droplet or droplets used for forming the particular dot can be reduced, thereby reducing an amount of spreading, in the main scanning direction, of the ink and thus an amount of growth, in the same direction, of the dot formed therewith and accordingly the black cell G. The recording apparatus includes the storage area 43*a* that stores a plurality of kinds of drive waveform signals that differ from one another in the number of ink droplets ejected in accordance therewith for formation of one dot. A suitable one is selected from the plurality of kinds of drive waveform signals stored in the storage area 43*a*, and outputted to the actuator unit. That is, the storage area 43*a* stores an exclusive drive waveform signal for each of a plurality of ranges of the environmental temperature, such that each exclusive drive waveform signal is for ejecting, for forming one dot, ink droplets in a number optimum for the range. When the inkjet recording apparatus is in operation, the kind of drive waveform signal corresponding to the current environmental temperature is selected from the plurality of kinds of drive waveform signals stored in the storage area 43*a*, and outputted to the actuator unit. Hence, the shape, size and density of dots are accurately controlled corresponding to the environmental temperature.

Further, even when the inkjet recording head has the individual specificity with respect to the flow resistance of the ink passage and others, a plurality of drive waveform signals corresponding to the specificity of each recording head can be produced, as needed, to eliminate adverse influence of the variation in the ink ejection characteristic due to the individual difference.

When the environmental temperature is not low and the ink viscosity is not so high that the amount of spreading of the ink in the main scanning direction is appreciably large, if the dot at the edge of the black cell G is formed by only one ink droplet, the print quality may deteriorate at the edge, due to shortage in the amount of the ink However, according to the apparatus of the second embodiment, three ink droplets are ejected to print each dot at the edge of the black cell G, when the environmental temperature exceeds the threshold, whereby the print quality at the edge of the black cell G is enhanced.

(2) The inkjet recording apparatus of the second embodiment can also enjoy the above-described effects (2)-(4) of the apparatus according to the first embodiment, since the first and second embodiments are identical except a part of the print control illustrated in FIG. 6.

is noted that although in the above-described second embodiment, the number of ink droplets ejected for one dot in the case of printing a dot immediately before and after which a dot is printed or to be printed, and that in the case of printing a dot immediately before or after which a dot is not printed or to be printed, are the same, namely, three. However, these ink droplets numbers may differ from each other.

The effects of the inkjet recording apparatus according to each of the first and second embodiments can be obtained even when the apparatus is adapted such that only one of the two dots adjacent, in the main scanning direction, to the particular dot to be printed is subjected to the determination of whether or not to print (or having been printed), when selecting a drive waveform signal to be outputted to the actuator unit. More specifically, the number of ink droplets ejected for forming one dot is reduced, when a dot is not to be printed either immediately before or immediately after the particular dot, or alternatively when the environmental temperature is not higher than the threshold and a dot is not to be printed either immediately before or immediately after the particular dot, thereby restraining the growth of a dot on the outline of the black cell of the barcode as a kind of image and at a front or rear edge to enhance the print quality.

Other embodiments of the invention (1) The number of ink droplets ejected for one dot according to the drive waveform signal A may be two or four or more. Further, although only one ink droplet is ejected for one dot according to the drive waveform signal B, the number of ink droplets ejected according to the drive waveform signal B may be any, e.g., two or three, as long as being smaller than the number of ink droplets ejected according to the drive waveform signal (2) The invention is applicable to printing of a barcode other than two-dimensional barcodes, and printing of an image other than barcodes.

(3) The invention is applicable to an inkjet recording apparatus using an actuator other than piezoelectric actuators using an electromechanical transducer such as piezoelectric element. For instance, the invention may be applied to an inkjet recording apparatus using an actuator using an electrothermal transducer as a drive source. Further, the invention is applicable to an inkjet recording apparatus of the type including an ink cartridge above the inkjet recording head, and to an inkjet recording apparatus including a scanner function or a copier function.

Correspondence Between Claims and the Embodiments

The piezoelectric element of the actuator unit 32 and the recording head 30 respectively correspond to the actuator and the recording head as recited in claims. The CPU 57, the image memory 51, the ROM 43, the RAM 44, the gate array 60 and the drive circuit 80 constitute the control device. The storage area 43*a* corresponds to the storing portion. A portion of the control device constituted by the CPU 57, the image memory 51, the ROM 43, the RAM 44, the gate array 60 and the drive circuit 80 assigned to implement the step S4 corresponds to the determining portion as well as a portion of the outputting portion which is assigned to make at least one of two determinations. A portion of the control device which is assigned to implement the steps S5 and S7 constitutes the selecting portion. The temperature sensor 59 corresponds to the temperature detecting portion.

What is claimed is:

1. An inkjet recording apparatus, comprising:

a recording head which is movable in a main scanning direction, and includes:

an ink passage with ink therein;

a nozzle in communication with the ink passage; and an actuator for applying energy to the ink in the ink passage to eject the ink in the form of a droplet from the nozzle;

a control device which outputs a drive waveform signal while the recording head is moved in the main scanning direction, in order to drive the actuator to eject the ink droplet, the control device including:

a temperature detecting portion which detects a temperature of an environment in which the apparatus is situated; and an outputting portion which makes at least one of the following two determinations, with respect to each particular one of dots printed in series at least in the main scanning direction: (a) a first determination whether there is a dot to be printed immediately before the particular dot, and (b) a second determination whether there is a dot to be printed immediately after the particular dot, and which outputs, to the actuator and for the particular dot, (i) a first one of a plurality of kinds of the drive waveform signals, which is for ejecting a first number of the ink droplets, when a result of the determination is affirmative, (ii) a second one of the plurality of kinds of the drive waveform signals, which is for ejecting a second number of the ink droplets, when the result of the determination is negative and the temperature detected by the temperature detecting portion is higher than a threshold, and (iii) a third one of the plurality of kinds of the drive waveform signals which is for ejecting a third number of the ink droplet or droplets, which third number is smaller than the second number, when the result of the determination is negative and the temperature detected by the detecting portion is not higher than the threshold.

2. The apparatus according to claim 1, wherein the outputting portion makes both of the two determinations.

3. The apparatus according to claim 1, wherein the outputting portion makes only the first determination.

4. The apparatus according to claim 1, wherein the outputting portion makes only the second determination.

5. The apparatus according to claim 1, wherein the plurality of kinds of the drive signals include a first kind of the drive signal for ejecting three ink droplets for one dot, and a second kind of the drive signal for ejecting one ink droplet for one dot.

6. The apparatus according to claim 1, wherein the control device further includes a distinguishing portion which makes a determination whether an image to be recorded is a barcode or not, the outputting portion being operated to make the at least one determination when a result of the determination made by the distinguishing portion indicates that the image to be recorded is a barcode, and not being operated to make the at least one determination when the result of the determination made by the distinguishing portion indicates that the image to be recorded is not a barcode.

7. The apparatus according to claim 1, wherein the control device further includes a storing portion which stores the plurality of kinds of the drive waveform signals that differ from one another in the number of the ink droplets ejected for printing one dot, and wherein the outputting portion of the control device includes a selecting portion which selects one of the plurality of kinds of the drive signals stored in the storing portion, based on the determination made by the outputting portion, and outputs the selected kind of the drive signal to the actuator, the selecting portion selecting, for the particular dot, and outputting to the actuator (i) the first kind of the drive signal for ejecting the first number of the ink droplets, when the result of the determination is affirmative, (ii) the second kind of the drive signal for ejecting the second number of the ink droplets, when the result of the determination is negative and the temperature detected by the temperature detecting portion is higher than the threshold, and (iii) the third kind of the drive signal for ejecting the third number of the ink droplet or droplets, when the result of the determination is negative and the temperature detected by the detecting portion is not higher than the threshold.

* * * * *